US009388579B2

(12) United States Patent
Pedersen et al.

(10) Patent No.: US 9,388,579 B2
(45) Date of Patent: Jul. 12, 2016

(54) PACKING OR TRANSPORT UNIT HAVING FIBROUS INSULATION ELEMENTS

(75) Inventors: Kurt Pedersen, Borup (DK); Herluf Nielsen, Hadsund (DK)

(73) Assignee: Rockwool International A/S, Hedehusene (DK)

( * ) Notice: Subject to any disclaimer, the term of this patent is extended or adjusted under 35 U.S.C. 154(b) by 0 days.

(21) Appl. No.: 13/883,203

(22) PCT Filed: Oct. 26, 2011

(86) PCT No.: PCT/EP2011/005386

§ 371 (c)(1),
(2), (4) Date: Mar. 24, 2014

(87) PCT Pub. No.: WO2012/059192

PCT Pub. Date: May 10, 2012

(65) Prior Publication Data

US 2014/0215961 A1 Aug. 7, 2014

(30) Foreign Application Priority Data

Nov. 5, 2010 (EP) ..... 10014330

(51) Int. Cl.
*E04B 1/00* (2006.01)
*E04D 13/16* (2006.01)
(Continued)

(52) U.S. Cl.
CPC ..... *E04D 13/16* (2013.01); *B65D 71/0096* (2013.01); *B65D 85/46* (2013.01); *B65D 2571/00043* (2013.01); *B65D 2571/00092* (2013.01); *Y10T 428/24942* (2015.01); *Y10T 428/24967* (2015.01); *Y10T 428/24992* (2015.01)

(58) Field of Classification Search
CPC ..... B65D 2571/00043; B65D 2571/00092; B65D 71/0096; B65D 85/46; E04D 13/16; Y10T 428/24942; Y10T 428/24967; Y10T 428/24992
USPC ..... 52/745.06, 79.2, 79.3, 223.5, 745.03; 428/212, 215; 414/788.1
See application file for complete search history.

(56) References Cited

U.S. PATENT DOCUMENTS 4,927,318 A * 5/1990 Hayden et al. ..... 414/802
6,045,324 A * 4/2000 Redman ..... 414/795.3
(Continued)

FOREIGN PATENT DOCUMENTS

CN 101107178 A1 1/2008
CN 101772607 A1 7/2010
(Continued)

*Primary Examiner* — Mark Wendell
(74) *Attorney, Agent, or Firm* — John Wilson Jones; Jones & Smith, LLP

(57) ABSTRACT

The invention relates to a packing- and/or transport unit comprising several fibrous insulation elements (4, 5) for flat roof insulation being arranged in at least one stack (2) and at least one support means (3) being arranged under the stack (2), whereby the stack (2) contains at least two different types of insulation elements (4, 5), which differ with respect to the material properties. A packing- and/or transport unit which is easy to handle and which allows to arrange most of the materials close to the places where it is needed is achieved in that the stacked insulation elements (4, 5) comprise lamellas (4) and/or lamella boards having a high compression strength but low point load resistance due to their fiber orientation and at least one insulation board (5) having an even higher compression strength and high point load resistance.

21 Claims, 4 Drawing Sheets

(51) Int. Cl.
*B65D 71/00* (2006.01)
*B65D 85/46* (2006.01)

(56) References Cited

U.S. PATENT DOCUMENTS

| | | | | |
|---|---|---|---|---|
| 6,158,176 | A * | 12/2000 | Perdue | 52/144 |
| 6,713,167 | B2 * | 3/2004 | Di Sante et al. | 428/292.1 |
| 6,998,359 | B2 * | 2/2006 | Bingenheimer | 442/36 |
| 7,073,306 | B1 * | 7/2006 | Hagaman | 52/745.09 |
| 7,232,605 | B2 * | 6/2007 | Burgueno et al. | 428/294.7 |
| 7,341,416 | B1 * | 3/2008 | Rubtsov | 414/412 |
| 7,393,577 | B2 * | 7/2008 | Day et al. | 428/121 |
| 7,803,729 | B2 | 9/2010 | Keller et al. | |
| 8,702,366 | B2 * | 4/2014 | Campbell et al. | 414/343 |
| 2003/0056458 | A1 * | 3/2003 | Black et al. | 52/541 |
| 2004/0149619 | A1 * | 8/2004 | Dybro et al. | 206/527 |
| 2005/0178091 | A1 * | 8/2005 | LaSalle | 53/443 |
| 2011/0271609 | A1 * | 11/2011 | Lewis | 52/143 |

FOREIGN PATENT DOCUMENTS

| | | | |
|---|---|---|---|
| DE | 3437446 | A1 | 5/1985 |
| DE | 10054186 | A1 | 5/2002 |
| DE | 102008004018 | A1 | 8/2008 |
| EP | 0664257 | | 7/1995 |
| EP | 1333128 | A1 | 8/2003 |
| EP | 1384678 | A1 | 1/2004 |
| EP | 2635502 | A1 | 11/2014 |
| WO | 0216223 | A1 | 2/2002 |
| WO | WO-03/000567 | A1 | 1/2003 |
| WO | 2012059192 | A1 | 5/2012 |

* cited by examiner

Fig. 2
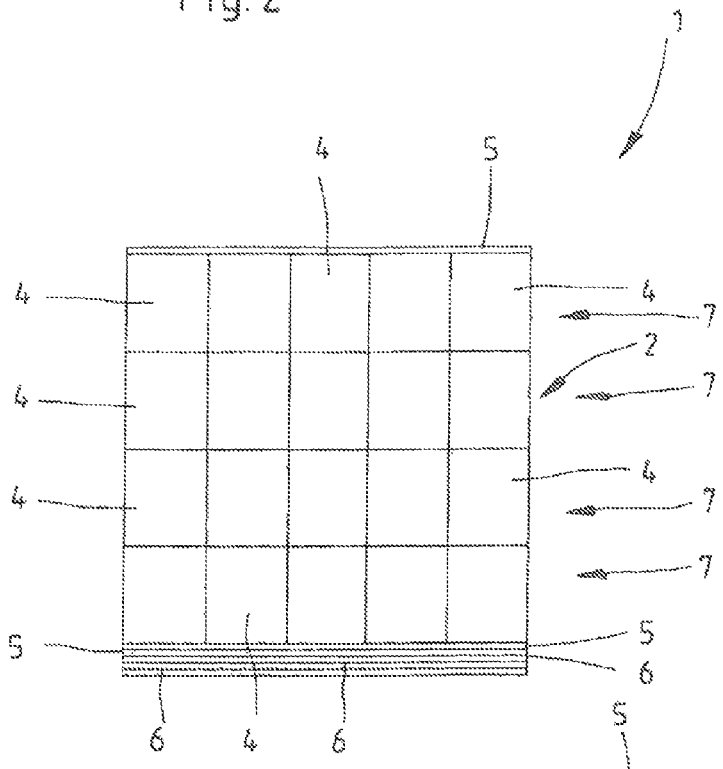
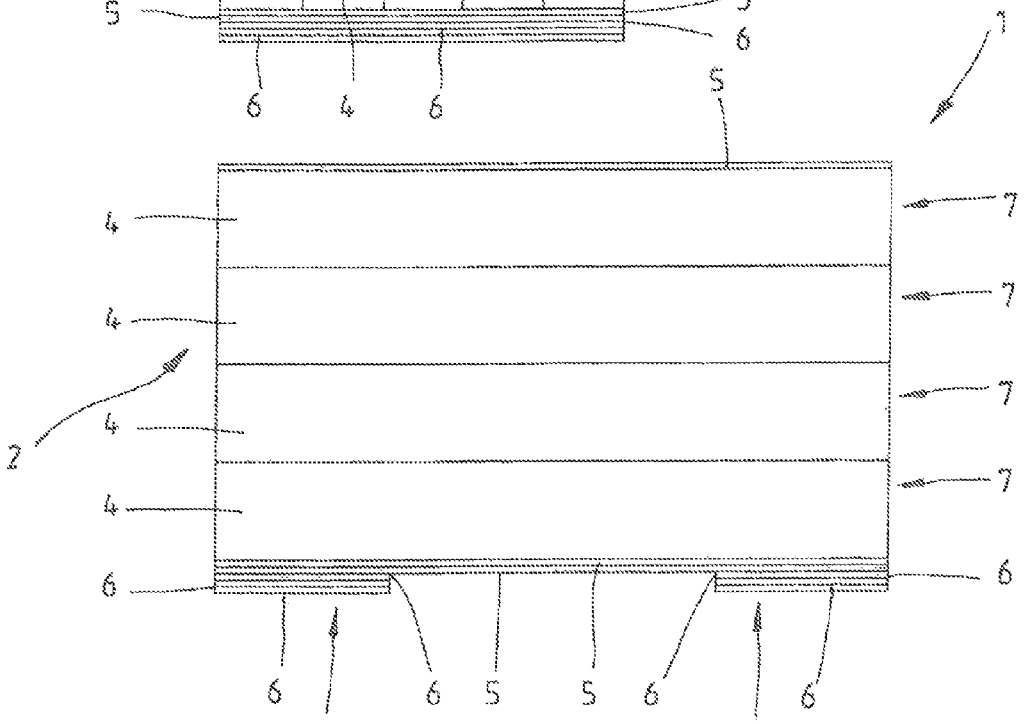
Fig. 3

Fig. 4
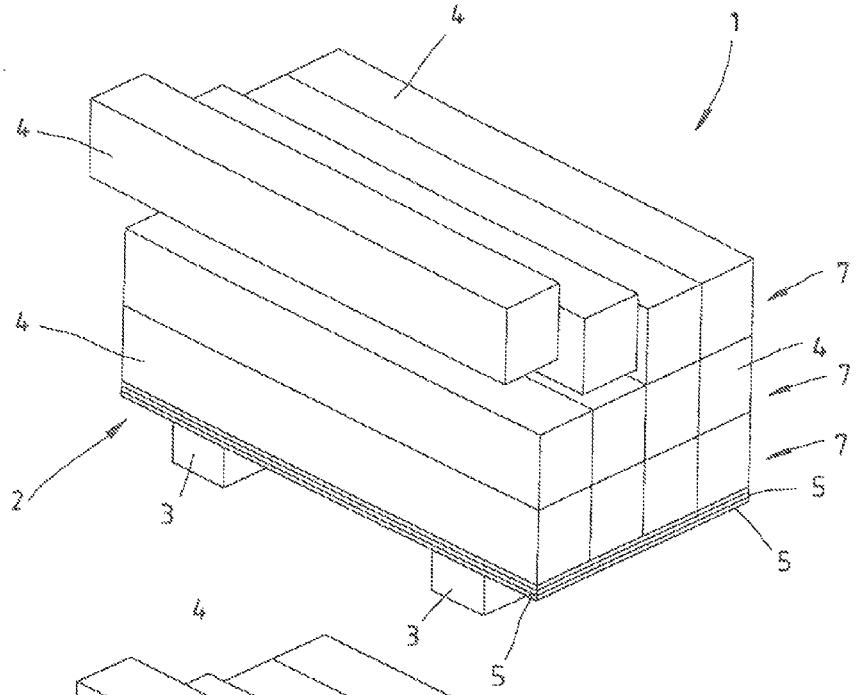
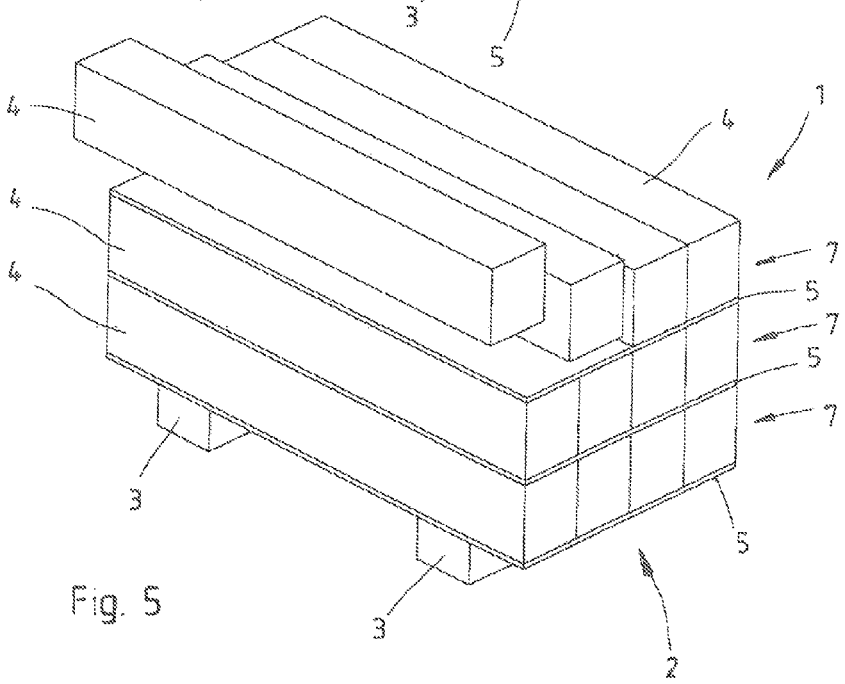
Fig. 5

PACKING OR TRANSPORT UNIT HAVING FIBROUS INSULATION ELEMENTS

The invention relates to a packing- and/or transport unit comprising several fibrous insulation elements for flat roof insulation being arranged in at least one stack and at least one support means being arranged under the stack, whereby the stack contains at least two different types of insulation elements, which differ with respect to the material properties, for example their compression strength. The invention relates furthermore to a method for producing an insulation layer on a flat or a flat inclined roof on a building, consisting of at least two different insulation elements being arranged stacked in the insulation layer, whereby the insulation elements are arranged in one packing- and/or transport unit. Finally the invention relates to a method for providing an insulation layer for a flat or a flat inclined roof in a packing- and/or transport unit, which insulation layer consists of at least two insulating elements being stacked and having different properties.

When the term "flat roof" is used in this specification it is meant to cover roofs that can be horizontal or can be inclined or sloping up to 20°. Often flat roofs are inclined by around 5°.

Packing- and/or transport units are well-known from the prior art. For example WO 03/000567 A1 discloses a transport unit which comprises a plurality of panels selected from a group consisting of insulating panels. The panels are preferably rectangular and are stacked in one or more adjoined stacks to form a pile of panels shaped as a substantially rectangular prism. The rectangular prism has a bottom surface, a top surface, a front surface, a back surface and at least two side surfaces. The bottom surface is supported using one or more support elements, wherein at least one of the support elements has a length of at least 15% of the perpendicular distance between the front surface and the back surface. The transport unit further comprises one or more carrying feet for carrying the pile of panels, wherein the carrying feet for carrying the pile of panels are at least partially in contact with the one or more support elements, where the one or more support elements represent the interface between the bottom surface of the panel pile and the carrying feet.

Furthermore WO 03/066984 A1 (corresponds to EP 1 333 128 A1) discloses a transport unit having an improved stability and comprising a plurality of panels of insulating material, where said panels are stacked on support means, wherein the transport unit comprises at least one stack of a number of stacked panels, at least one panel is provided with one or more partially slits, said panel being retained together and protected by wrapping foil. By providing an insulating panel with pre-cuts a transport unit may be provided for the good stability which improves both handling and transport of insulating panels between the producer of fibrous installation material and the end users at the building sites. According to WO 03/066984 A1 (corresponds to EP 1 333 128 A1), the insulating panels and the support means may consist of a fibrous material, but no other material properties are provided.

Finally DE 10 2008 004 018 A1 discloses a transport unit comprising wedge-shaped roof elements for a sloping roof. In one embodiment the transport unit comprises both ordinary roof elements as well as wedge-shaped elements. DE 10 2008 004 018 A1 describes that the ordinary elements can be arranged above the wedge-shaped elements, so that laying out the roof insulation can be done in an efficient manner.

Flat roof insulation often comprises at least two layers of different elements. One layer is preferably a thick insulation layer and the second layer is preferably a pressure resistant layer arranged on top of the insulation layer. The pressure resistant layer often has higher compression strength and also a higher point load resistance than the insulation layer, so that roofers and other people can walk safely on the roof. Often the thick insulation layer does not have sufficient strength to allow this. Additionally, there may be a pressure distribution layer arranged underneath the insulation layer.

When such a layer roof structure is applied it is conventional to have different types of packing- and/or transport units for example packing- and/or transport units with elements for the insulation layer, packing- and/or transport units with plate elements for the pressure resistant layer and packing- and/or transport units with elements for the pressure distribution layer. The roofer therefore needs to walk back and forth between these different packing- and/or transport units to select and pick the relevant elements for his work. Since all transport units cannot be arranged close to the working area, there is a lot of walking which takes time or at least, if a fast progress of work is needed, a lot of roofers working together.

It is an object of the invention to avoid the before mentioned drawbacks and to provide a packing- and/or transport unit which is easy to handle and which allows to arrange most of the materials close to the places where it is needed, especially insulation elements which are needed for providing multi-layered insulation for flat roofs of buildings.

A further object of the invention is to provide a method for producing an insulation layer on a flat or flat inclined roof on a building which allows a cost-saving production of such a roof.

Finally it is an object of the invention to provide a method for providing an insulation layer for a flat or a flat inclined roof in a packing- and/or transport unit, which allows a fast progress of producing a flat or a flat inclined roof on a building and which is therefore cost-saving in such work.

The objectives are achieved with a packing- and/or a transport unit according to the invention as defined in the claims especially with the packing- and/or transport unit in which the stack insulation elements comprise lamellas and/or lamella boards having a high compression strength but low point load resistance due to the fiber orientation and at least one insulation board having an even higher compression strength and high point load resistance.

The idea of the new and inventive packing- and/or transport unit is that each packing- and/or transport unit comprises insulation elements for at least two layers for flat roof insulation and that the total areas for each layer are similar. In this way the roofer can lay down at least two layers of the flat roof insulation with different material properties from only one packing- and/or transport unit, which saves him from walking to different packing- and/or transport units to pick different insulation elements.

Furthermore the objectives are achieved with a method for producing an insulation layer on a flat or a flat inclined roof on a building having the steps of taking at least a first insulation element from the packing- and/or transport unit, arranging the first insulation element in the insulation layer on the roof, taking at least a second insulation element from the packing- and/or transport unit and arranging the second insulation element on the first insulation element of the insulation layer, whereby the first and the second insulation element being arranged stacked in the insulation layer have different properties, especially a different compression strength, and whereby the first and the second insulation elements are arranged in the packing- and/or transport unit in that with the first insulation elements an insulation can be built-up, having a size being substantially equal to the size of an insulation being built-up with the second insulation elements.

Finally the objectives are achieved with a method for providing an insulation layer for a flat or a flat inclined roof in a packing- and/or transport unit, which insulation layer consists of at least two insulation elements being stacked and having different properties, whereby the different insulation elements of the insulation layer are arranged in fractions in the packing- and/or transport unit in such a manner that the insulation elements can be taken from the packing- and/or transport unit in succession according to the built-up progress and the array of the insulation elements in the insulation layer, preferably in that layers of insulation elements having different properties are provided with substantially equal areas.

In one embodiment of the invention the packing- and/or transport unit is characterized in that at least one insulation board is arranged underneath the stack of lamellas and/or lamella boards, which insulation board preferably lies on at least one support means. A lamella is a certain kind of an insulation element having a fiber orientation perpendicular to one of its big surfaces which big surfaces are on the one hand the surface which is oriented to the roof and on the other hand the surface which is oriented parallel to this surface. Such an orientation of the fibers has the big advantage that the compression strength of a lamella is higher than the compression strength of a fiber insulation element having a fiber orientation parallel to the same big surfaces. Lamellas can be produced in several different ways. One very common way is to cut the web of fibers insulation material perpendicular to its longitudinal axis into stripes of approximately 200 to 500 mm which stripes are turned around of 90°. However, there are also other ways to produce lamellas.

Lamella boards are produced by connecting at least two of the before mentioned lamellas to one board.

According to a preferred embodiment the lamellas and/or lamella boards have a density between 30 and 125 kg/m$^3$, preferably between 60 and 90 kg/m$^3$. These lamellas or lamella boards provide a high compression strength, so that they can be used in flat roofs. However, despite the high compression strength such lamellas and/or lamella boards are relatively weak in resisting point loads as when roofers walk on the roof. Therefore, they often require pressure resistant boards having higher point load resistance to be arranged on top of the lamellas and/or lamella boards. On the other hand lamellas and/or lamella boards with such densities are easy to handle and are sufficiently stable to withstand damages. The density of the insulation board is at least 70 kg/m3.

In particular each lamella and/or lamella board has an area which corresponds to an integer fraction of the area of the insulation board. According to this feature the insulation board has an area which is equal to the area which can be built-up by using two or more lamellas and/or lamella boards. Especially each insulation board being used in the packing- and/or transport unit has an area which is equal to the area of four or five lamellas.

In a preferred embodiment the support means, e. g. at least one carrying foot, comprises at least one, preferably two up to four stacked insulation boards and on top of these stacked insulation boards at least one, preferably two insulation boards having a bigger area than these insulation boards of the carrying foot. The support means is made from insulation material and can therefore be used in the roof insulation. Furthermore on top of the support means at least one, preferably two insulation boards having a bigger area are arranged. These insulation boards can also be used in roof insulation and the use of more than one insulation boards directly above the support means gives the whole packing- and/or transport unit a high stability so that this packing- and/or transport unit can be handled with machines as they are usually present on building sites.

In one embodiment at least one insulation board is arranged between layers made from lamellas and/or lamella boards. This embodiment has the big advantage that the roofer can for example pick first lamellas and arrange these on the roof. Afterwards the roofer picks an insulation board initially lying underneath the lamellas in the packing- and/or transport unit and arranges this insulation board on top of the lamellas which are already arranged on the roof. In the next step the roofer has the possibility to pick the next lamellas and after that the next insulation board.

Preferably the insulation boards have a thickness between 20 and 60 mm, preferably between 25 and 50 mm which gives together with the density of at least 70 kg/m$^3$ enough stability. The lamellas and/or lamella boards and/or the insulation boards are preferably made from mineral fibers, especially from stone wool. The mineral fibers are bound by artificial resin.

According to a further preferred embodiment with all stacked lamellas and/or lamella boards an area of insulation can be built-up which area of insulation has a size equal to the size of the total area of the stacked insulation boards or which size corresponds to an integer fraction on the area of the insulation board. These features of the packing- and/or transport unit provide the roofer with insulation elements for building-up an area on the roof which contains all necessary insulation elements so that one packing- and/or transport unit gives the roofer all materials for the insulation layer which are necessary for a certain area.

According to a further embodiment the size of an area of insulation of the lamellas and/or lamella boards being arranged in one or more layers of the stack underneath and/or above the insulation boards is equal to the size of an area of insulation of these insulation boards.

Preferably the packing- and/or transport unit has a length and a width dimension equal to the length and the width of an insulation board providing a layer of the stack.

Finally, according to a preferred embodiment the area of a layer of the stack consisting of lamellas and/or lamella boards is equal to the area of a layer of the stack consisting of at least one insulation board.

The packing- and/or transport unit according to the invention comprises therefore insulation elements for the insulation layer and insulation elements for the pressure resistant top layer. The insulation elements are preferably medium density mineral wool lamella elements with a height of 200 to 500 mm. The pressure resistant layer is preferably a high density mineral wool board with a thickness of 15 to 60 mm. These two different kinds of elements may be arranged in different stacking orders in the packing- and/or transport unit as will be described in the following description.

It is possible to arrange all insulation boards on top of the support means and all lamellas on top of these insulation boards. This arrangement gives the roofer the possibility to lay out all the lamella elements first and then take the lowermost insulation boards as pressure resistant plates and arrange them on top of the insulation layer made of the lamellas.

In another embodiment the insulation boards are arranged alternating with the lamellas so that the roofer can lay out at first a number of lamellas, than place a insulation board as a pressure resistant plate on top of the lamellas and then lay out the next number of lamellas before placing the next insulation board as a pressure resistant plate on top of these lamellas. At the end only the support means, for example the transport unit feet are left which are preferably made of mineral wool and can therefore be used in edges and corners where there is often a need for adjusting the insulation.

In order to further stabilize the packing- and/or transport unit one of the insulation boards being usable as pressure resistant plate can be arranged on top of the lamellas. Of course a better stability of the packing- and/or transport unit can be achieved by using more than one insulation board on top of the stack.

All before described advantages of the features of the preferred embodiments can also be of advantage in view of the method for producing an insulation layer on a flat or a flat inclined roof on a building or in view of a method for providing an insulation layer for a flat or a flat inclined roof in a packing- and/or transport unit for example in that lamellas and/or lamella boards having a high compression strength but low point resistance due to their fiber orientation and at least one insulation board having an even higher compression strength and high point load resistance are arranged as stacked insulation elements in the packing- and/or transport unit.

Embodiments of the packing- and/or transport unit according to the invention are described in the following with reference to the drawing in which FIG. 1 shows a packing- and/or transport unit in a first embodiment in a perspective view;

FIG. 2 shows the transport unit according to FIG. 1 in a first side view;

FIG. 3 shows the transport unit according to the FIGS. 1 and 2 in a second side view;

FIG. 4 shows a second embodiment of a packing- and/or transport unit in a perspective view:

FIG. 5 shows a third embodiment of a packing- and/or transport unit in a perspective view and FIG. 6 shows a fourth embodiment of a packing- and/or transport unit in a perspective view.

Figure 1:
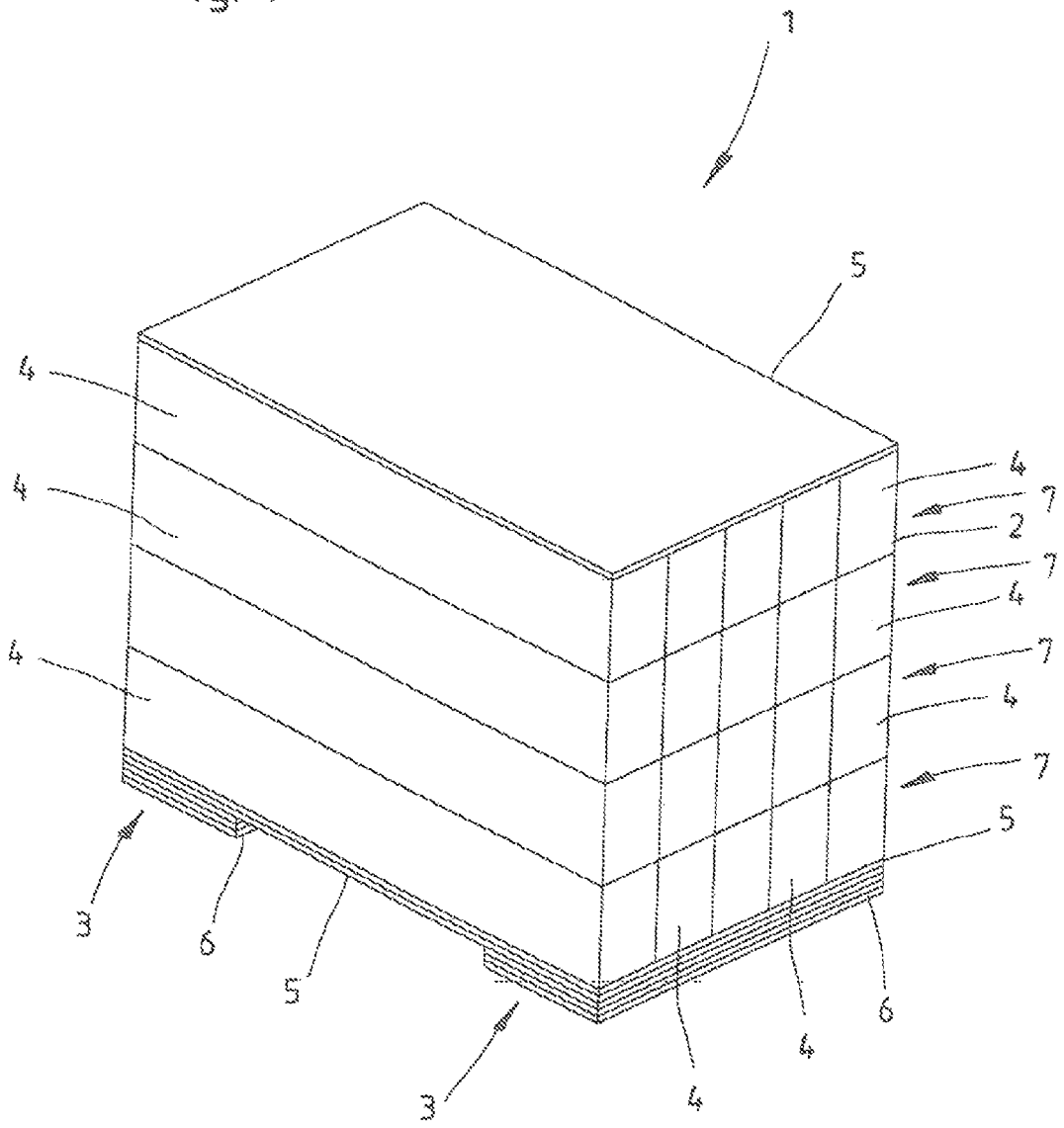

FIGS. 1 to 3 show a first embodiment of a packing- and/or transport unit 1 comprising several fibrous insulation elements for flat roof insulation being arranged in one stack 2. The stack 2 is arranged on two support means 3 being arranged under the stack 2, whereby the stack 2 contains two different types of insulation elements, namely lamellas 4 having a high compression strength and low point resistance due to their fiber orientation and insulation boards 5 having an even higher compression strength and high point load resistance and being used as pressure resistant layer in a flat roof insulation.

The support means 3 of the packing- and/or transport unit 1 of the embodiment according to FIGS. 1 to 3 consists of three parts 6 of an insulation board 5. These parts 6 are arranged at opposite ends of the packing- and/or transport unit 1 and run parallel to each other. The length of the parts 6 of the support means 3 is equal to the width of the insulation board 5 being arranged above the two support means 3 in a double layer arrangement which means that two insulation boards 5 are arranged above the support means 3 and underneath a first layer 7 of five lamellas 4.

The width of the insulation boards 5 is equal to the width of the layer 7 comprising five lamellas 4. The length of the insulation boards 5 is equal to the length of the lamellas 4 and the layer 7.

Each lamella 4 is arranged in the packing- and/or transport unit 1 in that the fiber orientation within the lamellas 4 is perpendicular to the area of the insulation board 5.

Each insulation board 5 has the dimensions 2000 mm length, 1200 mm width and 25 mm thickness whereas each lamella 4 has the dimensions 2000 mm length, 240 mm width and 300 mm thickness. The parts 6 of the support means 3 have the dimensions 1200 mm length, 500 mm width and 25 mm thickness.

On top of the stack 2 a further insulation board 5 equal to the insulation boards 5 above the support means 3 is arranged.

Of course, the whole stack 2 is enveloped in a foil which protects the lamellas 4, the insulation boards 5 as well as the support means 3 against water ingress and damages. The foil surrounds the whole stack 2 and the support means 3.

A second embodiment of a packing- and/or transport unit 1 is shown in FIG. 4. This second embodiment of the packing- and/or transport unit 1 differs from the embodiment according to the FIGS. 1 to 3 in that the support means 3 consists of stripes made of mineral fibers. For example lamellas can be used as such stripes.

Furthermore the embodiment according to FIG. 4 differs from the embodiment according to the FIGS. 1 to 3 in that three insulation boards 5 are arranged on top of the support means 3 and that three layers 7 of lamellas 4 are arranged on top of the insulation boards 5.

A further embodiment of a packing- and/or transport unit 1 is shown in FIG. 5 which has three layers 7 of lamellas 4 each layer 7 comprising four lamellas. Between two layers 7 an insulation board 5 is arranged. Furthermore an insulation board 5 is arranged underneath the lowest layer 7 on top of the support means 3.

Figure 6:
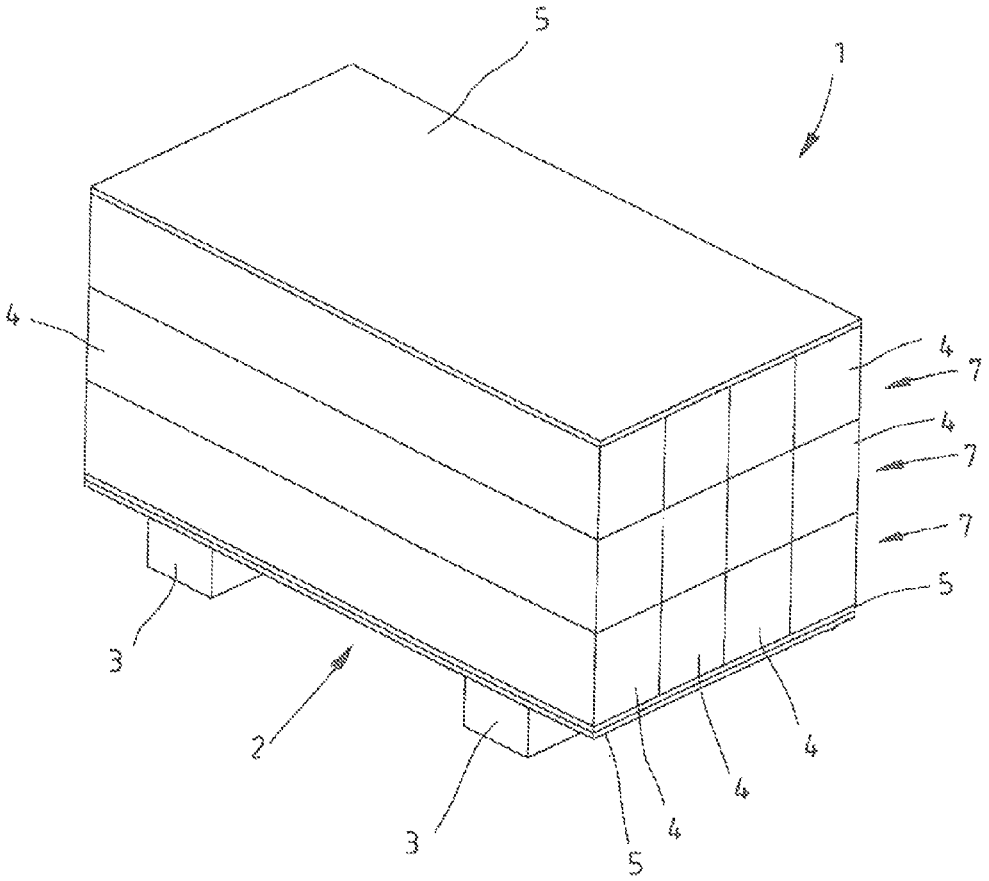

Finally a further embodiment of the packing- and/or transport unit 1 is shown in FIG. 6 which consists of three layers 7 of lamellas 4 which are arranged on top of two layers of insulation boards 5 on top of two support means 3 and which has a covering insulation board 5 on top of the layers 7.

Of course all the before mentioned packing- and/or transport units 1 have a foil surrounding the stack 2 at least partly as to simplify the use of the packing- and/or transport unit with a machinery usually used on building areas. Furthermore the foil protects the packing- and/or transport unit against water ingress and damages.

The lamellas 4 and the insulation boards 5 are made from mineral fibers, preferably from stone wool which mineral fibers are bound with artificial resin.

The preferred embodiment according to FIGS. 1 to 3 shows a packing- and/or transport unit 1 with three parts 6 of insulation boards 5 to built-up each support means 3, then two insulation boards 5 being used as pressure resistant boards and then four layers 7 of lamellas 4 and finally a further insulation board 5 being used as a pressure resistant board. In this embodiment each of the three insulation boards 5 has the same area as three of the layers 7 of lamellas 4. A further resistant board can be built-up of four of the six parts 6 arranged as support means 3 under the stack 2. Therefore four of the six parts 6 correspond in area to the area of the fourth layer 7 of the lamellas 4. The last two parts 6 can be used if possible for filling out openings in the flat roof insulation.

With an embodiment of the packing- and/or transport unit according to FIGS. 1 to 3 a roofer can pick out first the insulation board 5 before picking out the five lamellas 4 of the first layer 7 which can be arranged on the flat of flat inclined roof before the first insulation board 5 is laid on top of the first five lamellas 4.

After that the roofer can take out the lamellas 4 of the three further layers 7 and then cover the before mentioned lamellas 4 arranged on the roof with the insulation boards 5 being arranged on top of the support means 3. The last five lamellas 4 of the last layer 7 can be covered with the parts 6 forming the support means 3 so as to built-up an insulation layer having two layers of insulation elements with different properties.

With the packing- and/or transport unit 1 according to FIG. 4 the roofer can lay out all the lamella elements first and then take the lowermost insulation boards 5 and put it as pressure resistant plates on top of the lamellas 4.

With a packing- and/or transport unit 1 according to FIG. 5 the roofer can lay out four lamellas 4, then place an insulation board 5 as a pressure resistant plate on top of the four lamellas 4, then lay out the next four lamellas 4, then a further insulation board 5, then four lamella 4 and then the last insulation board 5. At the end only the support means 3 are left. These support means 3 are also made of mineral wool and can be used in edges and corners where there is often a need for adjusting the insulation.

LIST OF REFERENCE NUMBERS

1 packing- and/or transport unit
2 stack
3 support means
4 lamella
5 insulation board
6 part of insulation board
7 layers

The invention claimed is:

1. A packing or transport unit comprising several fibrous insulation elements for flat roof insulation being arranged in at least one stack and at least one support being arranged under the stack, whereby the stack contains at least two different types of insulation elements, which differ with respect to their material properties characterized in that the stacked insulation elements comprise lamellas or lamella boards having a high compression strength and point load resistance attributable to their fiber orientation and at least one insulation board and wherein the compression strength and point load resistance is higher for the at least one insulation board than the lamellas or lamella boards.

2. The packing or transport unit according to claim 1, characterized in that at least one insulation board is arranged underneath the stack of lamellas or lamella boards.

3. The packing or transport unit according to claim 2, characterized in that the support comprises at least one stacked insulation board and that on top of the at least one stacked insulation board at least one insulation board of larger area is arranged.

4. The packing or transport unit according to claim 2, characterized in that, the lamellas or lamella boards have a density between 30 and 125 kg/m3.

5. The packing or transport unit according to claim 2 characterized in that, at least one insulation board is arranged between layers made from lamellas or lamella boards.

6. The packing or transport unit according to claim 2 characterized in that with all stacked lamellas or lamella boards an area of insulation can be build up which area of insulation has a size equal to the size of the total area of the stacked insulation boards or which size corresponds to an integer fraction of the area of the insulation board.

7. The packing or transport unit according to claim 2, characterized in that said insulation board lies on at least one support.

8. The packing or transport unit according to claim 7, characterized in that the at least one support is made of mineral fibers.

9. The packing or transport unit according to claim 1 characterized in that, the lamellas or lamella boards have a density between 30 and 125 kg/m3.

10. The packing or transport unit according to claim 9 characterized in that the lamellas, lamella boards, insulation boards or a combination thereof are made from mineral fibers.

11. The packing or transport unit according to claim 10, characterized in that the lamellas, lamella boards, insulation boards or a combination thereof are made from stone wool.

12. The packing or transport unit according to claim 1 characterized in that, each lamella or lamella board has an area which corresponds to an integer fraction of the area of the insulation board.

13. The packing or transport unit according to claim 1 characterized in that, at least one insulation board is arranged between layers made from lamellas or lamella boards.

14. The packing or transport unit according to claim 1 characterized in that, the at least one insulation board has a thickness between 20 and 60 mm.

15. The packing or transport unit according to claim 1 characterized in that the lamellas or lamella boards or the at least one insulation board are made from mineral fibers.

16. The packing or transport unit according to claim 15, characterized in that the lamellas, lamella boards, insulation boards or a combination thereof are made from stone wool.

17. The packing or transport unit according to claim 1 characterized in that all of the stacked lamellas or lamella boards have an area of insulation has a size equal to the size of the total area of the stacked insulation board or a size corresponding to an integer fraction of the area of the insulation board.

18. The packing or transport unit according to claim 1 characterized in that the size of an area of insulation of the lamellas or lamella boards being arranged in one or more layers of the stack underneath or above the insulation boards is equal to the size of an area of insulation of the insulation boards.

19. The packing or transport unit according to claim 1 characterized having a length and width dimension equal to the length and the width of an insulation board providing a layer of the stack.

20. The packing or transport unit according to claim 1 characterized in that the area of a layer of the stack consisting of lamellas or lamella boards is equal to the area of a layer of the stack consisting of at least one insulation board.

21. The packing or transport unit according to claim 1, wherein the orientation of fibers within the lamellas or lamella boards is perpendicular to the area of the insulation board.

* * * * *